United States Patent [19]

Koorneef et al.

[11] Patent Number: 4,614,501

[45] Date of Patent: Sep. 30, 1986

[54] METHOD OF MANUFACTURING A COLOR CATHODE-RAY TUBE COMPRISING A MAGNETIC QUADRUPOLE POST-FOCUSING MASK AND DEVICE FOR CARRYING OUT THE METHOD

[75] Inventors: Jacob Koorneef; Robert H. J. Fastenau; Paulus J. J. M. van der Heijden, all of Eindhoven, Netherlands

[73] Assignee: U.S. Philips Corporation, New York, N.Y.

[21] Appl. No.: 645,877

[22] Filed: Aug. 29, 1984

[30] Foreign Application Priority Data

Sep. 5, 1983 [NL] Netherlands ..... 8303076

[51] Int. Cl.[4] ..... H01J 9/236

[52] U.S. Cl. ..... 445/47; 335/212; 313/403

[58] Field of Search ..... 445/36, 37, 47, 51; 313/402, 403; 335/212, 284

[56] References Cited

U.S. PATENT DOCUMENTS 4,135,111 1/1979 Verweel ..... 313/403

4,428,736 1/1984 Verweel et al. ..... 313/403 X

*Primary Examiner*—Kenneth J. Ramsey

*Attorney, Agent, or Firm*—David R. Treacy

[57] ABSTRACT

In a method of manufacturing a color cathode-ray tube comprising a magnetic quadrupole post-focusing mask (7) the mask (7) is formed by a plate of permanent magnetizable material in which apertures (9) are provided arranged according to rows. Sections of the plate are successively magnetized by positioning parallel conductors (21, 22, 23) on at least one side of the plate in such manner that each time two conductors through which an electric current flows in opposite directions are situated between two rows of apertures (9) and a magnetic quadrupole is formed along the circumference of each of the apertures (9). A number of outermost conductors (30, 31, 32, 33) determines an edge area of the section. In order to prevent the occurrence of disturbing magnetization errors in the edge area, the edge area is made to coincide with a part of a preceding section already magnetized according to the desired strength. A magnetic induction is generated in the edge area according to a pattern corresponding to the existing pattern in the preceding section but having a strength which decreases towards the outermost conductor (30).

13 Claims, 7 Drawing Figures

METHOD OF MANUFACTURING A COLOR CATHODE-RAY TUBE COMPRISING A MAGNETIC QUADRUPOLE POST-FOCUSING MASK AND DEVICE FOR CARRYING OUT THE METHOD

BACKGROUND OF THE INVENTION

The invention relates to a method of manufacturing a colour cathode-ray tube comprising a magnetic quadrupole post-focussing mask formed by a plate of a magnetisable material in which apertures are provided so as to be arranged according to rows, sections of said plate being successively magnetized by positioning parallel conductors per section on at least one side of the plate in such manner that each time two conductors through which an electric current flows in opposite directions are present between two successive rows of apertures, a magnetic quadrupole being formed along the circumference of each of the apertures.

The invention relates also to a device for carrying out such a method.

Such a method of manufacturing a colour cathode-ray tube comprising a magnetic quadrupole post-focusing mask is disclosed in Netherlands Patent Application No. 8002303. The object of magnetic post-focusing is to increase the transmission of the mask. In tubes without post-focusing a very large part, for example 80 to 85%, of the electrons is intercepted by the so-called shadow mask. When magnetic post-focusing is used the apertures in the mask may be made larger since as a result of the focusing in the mask apertures the electron spots on the screen are considerably smaller than the mask apertures so that sufficient space is available between the electron spots of the various electron beams. As a result of the presence of a magnetic quadrupole lens in each of the apertures of the mask, the electron beams upon passing a mask aperture are focused in one direction and are defocused in a direction at right angles thereto.

In the known method, magnetisation of the mask plate is done by means of a magnetizing device comprising two sets of parallel conductors which mutually are oriented substantially at right angles and are provided on either side of the plate. Two conductors through which an electric current flows in opposite directions of the respective systems always extend between two rows and two columns respectively, of mask apertures. The directions of flow in the two systems of conductors are chosen to be so that a magnetic quadrupole is formed along the circumference of each of the mask apertures. It is thus possible to permanently magnetize the mask plate throughout its surface in one operation. For practical reasons, however, it may be desired not to magnetize the entire mask plate in one operation but in sections. The energy required for the magnetization then need not be supplied at one time but may be supplied in successive steps per section. Moreover, smaller magnetisation coils may be used which need extend only over one section. As a result of this, the required size accuracy of the coils can more easily be met. The problem occurs, however, that when the known magnetisation device is used, a magnetisation which deviates from the desired magnetisation and which in the operating tube causes a visible disturbance in the displayed picture occurs in the boundary region between two individually magnetized sections. Investigations have proved that the deviating magnetisation formed in the said boundary region is caused by magnetic fields which are generated by the magnetisation device and extend beyond the sets of conductors. At the edges of the systems of conductors said so-called edge fields during magnetizing a given section disturbs the magnetisation of a previously magnetized adjoining section. In the known magnetization device the ends of the parallel conductors are interconnected in a zig-zag manner and bent at right angles to the plane through the conductors. By this measure, however, the interfering influence of the edge fields is removed only at the edges which are at right angles to the conductors. The disturbing influence of the edge fields at the edges which extend parallel to the conductors is not removed.

SUMMARY OF THE INVENTION

It is an object of the invention to provide a method of manufacturing a colour cathode-ray tube comprising a magnetic quadrupole post-focusing mask in which the disturbing influence of magnetic edge fields at the edges parallel to the conductors is minimized.

Another object of the invention is to provide a device for carrying out said method.

For that purpose, according to the invention, a method of manufacturing a colour cathode-ray tube comprising a magnetic quadrupole post-focusing mask formed by a plate of a magnetizable material in which apertures are provided so as to be arranged according to rows, sections of said plate being successively magnetized by positioning parallel conductors per section on at least one side of the plate in such manner that each time two conductors through which an electric current flows in opposite directions are present between two successive rows of apertures, a magnetic quadrupole being formed along the circumference of each of the apertures, is characterized in that a first section is magnetized and then at least one subsequent section is magnetized, which subsequent section comprises an edge area extending parallel to the parallel conductors and coinciding with a part of a preceding section magnetized already in accordance with the desired strength and a magnetic induction is generated in the edge area according to a pattern corresponding to the already existing pattern of magnetisation in said preceding section but the strength of which decreases towards the outermost of the parallel conductors.

Without using the invention, a magnetic field is generated by the magnetization device. This magnetic field extends beyond the system of conductors and the strength thereof decreases with the distance to the outermost conductor increasing.

The direction of said magnetic field and hence the pattern of magnetic induction generated thereby, however, does not everywhere adjoin the desired magnetic quadrupole formation along the circumference of the apertures in the mask plate. The result is that upon magnetizing a section the pattern of magnetisation of an adjoining, previously magnetized, section is disturbed. Such a disturbance is avoided by using the invention. The pattern of induction generated according to the invention in the edge area of the section does not disturb the pattern of magnetisation in the adjoining section and removes the above-mentioned disturbing influence of the magnetic field in the edge area.

A special embodiment of the invention is characterized in that upon magnetizing the said subsequent section a central area and two edge areas of the mask section extending on either side of the central area and parallel to the parallel conductors are magnetized, the strength of the magnetic induction in each of the edge areas decreasing towards the outermost of the parallel conductors. According to this embodiment the disturbing influence of magnetic fields in the two said edge areas is removed when said edge areas coincide with parts of central areas of previously magnetized mask sections. When one or both edge areas adjoin not yet magnetized sections, said method has the advantage that in the said edge areas no magnetization pattern of an undesired form is formed. Upon magnetizing a mask section in which a pattern of magnetization is already present which differs considerably from the desired pattern, it is very difficult to remove said incorrect magnetization without leaving residual magnetization. Mask sections in which the magnetization pattern is at least substantially correct but in which, for example, the magnetization has too small a strength can be magnetized again by means of the invention without side effects occurring in the surrounding mask sections. In this connection local correction or changes in the magnetization of the mask can simply be carried out.

The width of the above-described edge area is determined by a number of outermost parallel conductors of the magnetization device. The choice of said number of conductors is comparatively free. It has been found empirically that an edge area of at least three outermost parallel conductors will suffice.

According to an embodiment of the invention the decreasing strength of the magnetic induction in an edge area is obtained by causing the current strength in the conductors which determine an edge area to decrease per conductor towards the outermost conductor. The decreasing strength of the magnetic induction in the edge area can also be realized according to the invention by giving the conductors in the edge area towards the outside successively a larger distance to the plate to be magnetized.

According to the invention the magnetization of a section can be realized by means of first and second parallel conductors. An embodiment in accordance with the invention is characterized in that the magnetization of a section is carried out by positioning first parallel conductors on one side of the plate and second parallel conductors on the other side of the plate, said first and second parallel conductors crossing each other. A modification of said embodiment consists in that the magnetization of a section is carried out by positioning first parallel conductors on one side of the plate and second parallel conductors on the other side of the plate, said first and second parallel conductors extending parallel to each other.

A device for carrying out the method according to the invention is characterized in that the device comprises at least a first and a second set of mutually parallel conductors, which sets are juxtaposed on an insulating support, the conductors of the first set being interconnected in a zig-zag manner and the conductors of the second set consisting of individual conductors each having their own electrical terminals.

An embodiment of this device is characterized in that a set of at least three individual conductors each having their own electrical terminals is situated on either side of the set of conductors interconnected in a zig-zag manner.

A further embodiment of the device is characterized in that the insulating support is an aluminium support anodized at least at the surface. It has been found that such supports can very accurately be manufactured and as regards accuracy readily satisfy the requirements imposed for the present invention. A particularly favourable embodiment is characterized in that the support has positioning grooves in which the conductors are present.

BRIEF DESCRIPTION OF THE DRAWINGS

Embodiments of the invention will now be described in greater detail, by way of example, with reference to the accompanying drawing, in which.

DESCRIPTION OF THE PREFERRED EMBODIMENT

Figure 1:
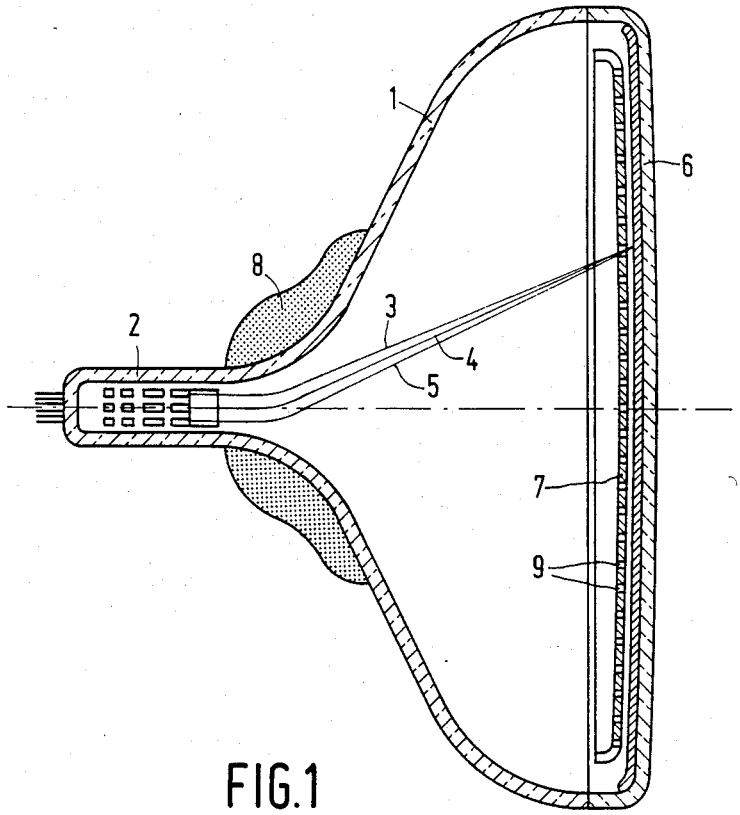
FIG. 1 is a sectional view of a colour display tube comprising a magnetic quadrupole post-focusing mask.

The tube shown in FIG. 1 comprises a glass envelope 1, means 2 to generate three electron beams 3, 4 and 5, a display screen 6, a magnetic quadrupole post-focusing mask 7, and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue and the longitudinal direction of which is at right angles to the plane of the drawing of FIG. 1. In normal operation of the tube the phosphor strips are vertical and FIG. 1 hence is a horizontal sectional view of the tube. The mask 7 which will be described in detail with reference to FIGS. 2 and 3, comprises a large number of apertures 9 which are shown diagrammatically only in FIG. 1. A magnetic quadrupole lens is formed in each of the apertures 9. The three electron beams 3, 4 and 5 pass through the apertures 9 at a small angle with each other and consequently each impinge only on phosphor strips of one colour. The apertures 9 in the mask 7 are thus very accurately positioned with respect to the phosphor strips of the display screen 6.

Figure 2:
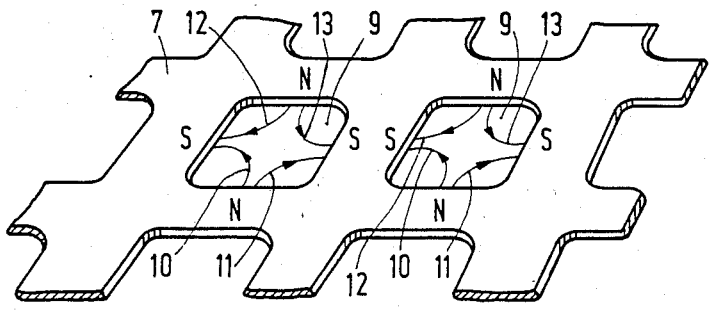
FIG. 2 is a perspective view of a part of the mask of the display tube of FIG. 1, FIG. 3 explains the principle of the focusing by means of a magnetic quadrupole lens, FIGS. 4*a* and 4*b* explain an embodiment of a first method of manufacturing a colour display tube according to the invention.

FIG. 2 is a perspective view of a part of the mask 7 of the display tube shown in FIG. 1. The mask 7 consists of a plate of a permanent magnetizable material, for example, a steel which can be rolled and can be etched for the manufacture of the apertures 9, comprising, for example, in percent, by weight 20% iron, 20% nickel and 60% copper or 56% iron, 27% chromium, 15% cobalt, 1% niobium and 1aluminium, or a material which is used for magnetic recording (for example $\gamma$-$Fe_2O_3$ or 90% cobalt and 10% phosphor or 90% nickel and 1% phosphor) on a non-ferrogmagnetic carrier, for example, of aluminium. The plate is then magnetized in such manner that the magnetic poles indicated in FIG. 2 by N and S are obtained. The four magnet poles (N-S-N-S) form a magnetic quadrupole field a few field lines of which are denoted by 10, 11, 12 and 13. The way in which the magnetization is carried out will be further explained with reference to FIGS. 4 and 5. The apertures in FIG. 2 are square with rounded corners. However, the invention is not restricted to this shape of the apertures. For example, the apertures 9 may also be circular or hexagonal with or without rounded corners. In the FIG. 2 embodiment the thickness of the mask 7 is equal to 0.15 mm and the apertures 9 have the dimensions 0.6×0.6 mm., the pitch between the apertures being 0.8 mm.

Figure 3:
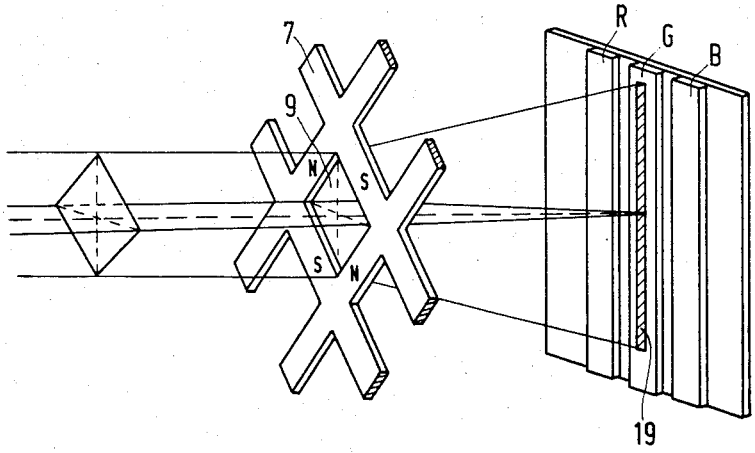

The principle of a magnetic quadrupole lens will be explained with reference to FIG. 3 in which such a magnetic quadrupole lens in an apertures 9 of the mask 7 is shown diagrammatically. The variation of the magnetization along the edge of the aperture 9 is indicated by N,S, N,S in such manner that a quadrupole field is formed. The electron beam which passes through the aperture 9 is focused in the horizontally shown plane and is defocused in the vertically shown plane as a result of which the electron spot 19 is formed when the display screen is in the horizontal point of focus. So the cross-section of the electron beam is elongate in the vertical direction and is made narrower in the horizontal direction. It is only of minor influence on the focusing when the electron beam passes through the aperture 9 at a small angle. As a result of this the colour selection of the three electron beams 3, 4 and 5 take place in a manner quite analogous to that of the known shadow mask tube. Due to the strong focusing, however, the aperture 9 may be much larger than in the known shadow mask tube, as a result of which a far greater amount of electrons impinge on the display screen 6, and a brighter picture is obtained. The defocusing in a vertical direction need not be a disadvantage when phosphor strips are used which are parallel to the longitudinal direction of the spot 19.

A method of manufacturing a colour display tube comprising a mask having a large number of magnetic quadrupole lenses can be carried out in a number of manners.

Figure 4A:
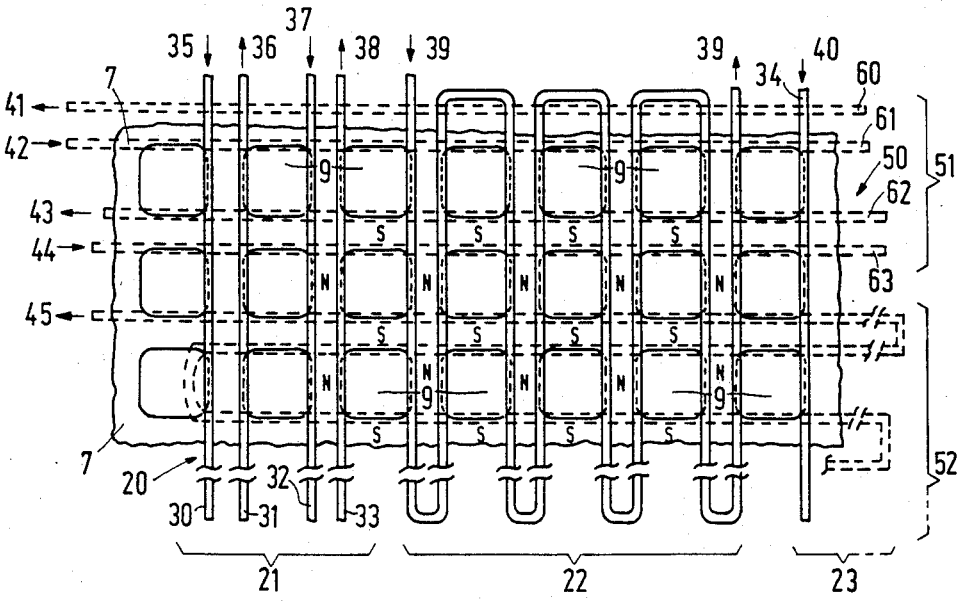
FIG. 4*c* shows a device for the method explained with reference to FIGS. 4*a* and 4*b* and FIG. 5 explains an embodiment of a second method of manufacturing a colour display tube according to the invention.

An embodiment of a first method will be described with reference to FIG. 4*a*, which is an elevation of a section of the mask 7 having apertures 9. A coil 20 having three sets of parallel conductors is provided on the mask 7. The coil 20 comprises a first set 22 of conductors which are interconnected in a zig-zag manner, a second set 21 consisting of four individual conductors 30, 31, 32 and 33, and a third set 23 of likewise four individual conductors of which only one is shown in the figure and is referenced 34. An identical coil 50 is provided on the lower side of the mask 7. The conductors of the coil 50 in the example shown are positioned at right angles to the conductors of the coil 20. Each time two conductors of the coil 50 extend between two rows of apertures 9 and each time two conductors of the coil 20 extend between two columns of apertures 9. For magnetizing the mask section present between the coils 20 and 50 electric currents pass through the sets 21, 22 and 23 in the directions denoted by the arrows 35, 36, 37, 38, 39 and 40. At the same time electric currents pass through the three corresponding sets of the coil 50 in the directions denoted by the arrows 41, 42, 43, 44, 45. Of the coil 50, only the set 51 with the individual conductors 60, 61, 62 and 63 and a part of the set of conductors 52 interconnected in a zig-zag manner is shown in the figure. A section of the mask 7 is magnetized by the magnetic fields generated by the currents. The size of said section is determined by the area of the mask 7 present between the coils 20 and 50. Said section in the given example comprises four edge areas, namely an edge area determined on the left-hand side of the section by the conductors 30, 31, 32 and 33, an edge area determined on the upper side of the section by the conductors 60, 61, 62 and 63, an edge area determined on the right-hand side of the section by the set 23, and a fourth edge area which is not shown in the figures but which is situated on the lower side of the section and is determined by a set of individual conducuctors of the coil 50 determined in a manner analogous to that of the upper side. The edge areas enclose a central region of the section which is present between the zig-zag-like interconnected sets 22 and 52. When currents pass through the conductors in the directions denoted by the arrows, a north-pole (N), a south-pole (S), a north-pole (N) and a south-pole (S) are formed cyclically around each aperture 9. In the edge areas the strength of the magnetization decreases towards the outermost conductor. This is realized by causing the current strength in the outermost conductors of the coils 20 and 50 to decrease per conductor. In a specific example the current indicated by the arrows 38, 37, 36 and 35 in the left-hand edge area of the section have strengths of 650 A, 400 A, 200 A and 140 A, respectively. The current strength of the current indicated by the arrows 39 through the set of conductors 22 is approximately 1000 A. In the edge area on the upper side of the section, the currents indicated by the arrows 44, 43, 42 and 41 correspondingly have strengths of 650 A, 400 A, 200 A and 140 A, respectively, while the current strength of the current through the set of conductors 52 indicated by the arrow 45 again is approximately 1000 A. For the remaining two edge areas the currents through the conductors are chosen in agreement with the currents for the edge areas described. For example, the current strength of the current indicated by the arrow 40 is again 650 A and the current strength for the last three conductors of the set 23 not shown decrease as indicated for the conductors of the set 21.

Figure 4B:
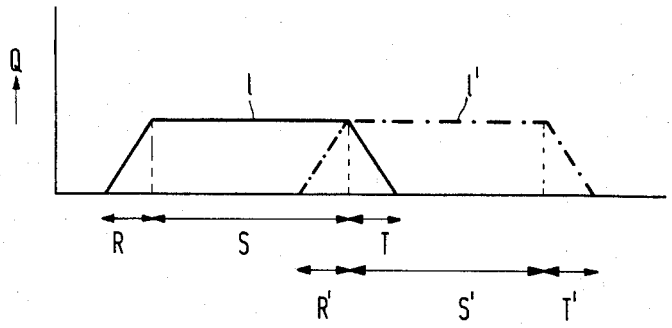

After a section of the mask 7 has thus been magnetized, a subsequent section is magnetized in an analogous manner. FIG. 4*b* illustrates this section-wise magnetization of the mask 7 by means of a diagram for two successive sections. In FIG. 4*b* the edge area determined by the set of conductors 21 (FIG. 4*a*) is denoted by R. The central area determined by the set 22 is denoted by S and the edge area determined by the set 23 is denoted by T. The generated quadrupole strength Q is plotted on the vertical axis. The variation of said quadrupole strength along a horizontal row of apertures 9 of the section in FIG. 4*a* is shown diagrammatically by means of a trapezoidal shape 1. After the section with central area S and edge areas R and T has been magnetized, the coils 20 and 50 in FIG. 4*a* are moved to the right for the magnetization of a subsequent section. This subsequent section has a central area S′ and edge areas R′ and T′ in agreement with the areas R, S and T. The coils 20 and 50 are moved to the right until the edge area R′ coincides with a part of the central area S. The central areas S and S′ need not adjoin exactly each other as is shown in FIG. 4*b*. The movement of the coils 20 and 50 may also be such that the central area S′ overlaps the central area S partly. After positioning the coils 20 and 50 these are energized as described with reference to FIG. 4*a*. The magnetic induction in the edge area R′ does not disturb the magnetization in the central area S, while the magnetization in the edge area T is brought at the desired strength. The trapezoidal shape 1′ indicates the variation of the quandrupole strength along a horizontal row of apertures 9 in said subsequent section, on the understanding that the quadrupole strength in the overlapping area of 1 and 1' has the value of that in the area S and S'. In this manner the mask 7 is magnetized section by section by stepwise movement of the coils in the horizontal and/or vertical direction and a mask is obtained which no longer comprises magnetization defects disturbing the picture quality.

Figure 4C:
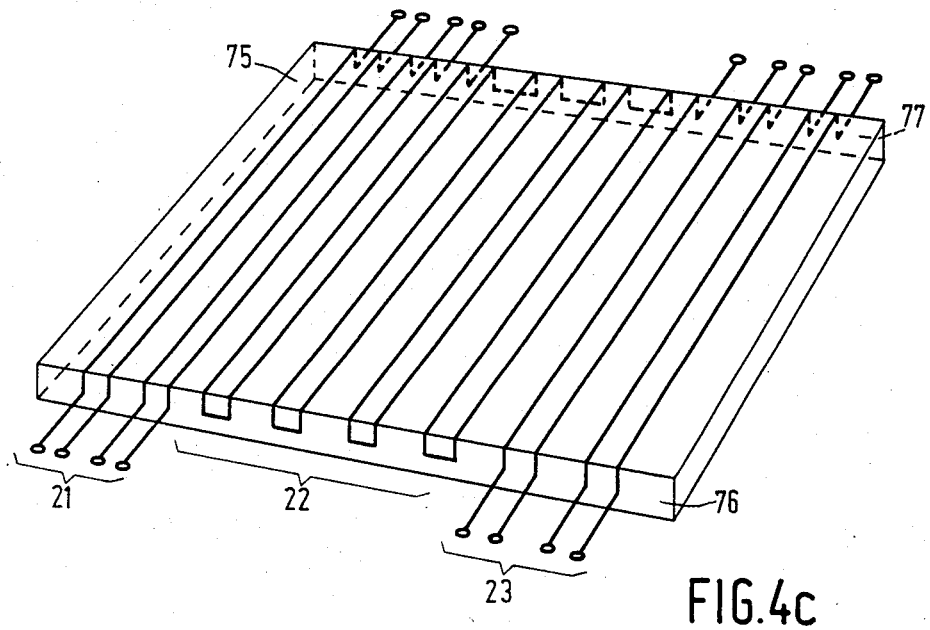

FIG. 4*c* shows diagrammatically the coil 20 of the coils 20 and 50 of the device with which the method described with reference to FIG. 4*a* has been carried out. The mutual distances between the parallel conductors should correspond very accurately to the width of the bridges between the apertures 9 and the size of the apertures 9 in the mask 7. For that purpose, the zig-zag-like interconnected sets of conductors 22 and on either side thereof the sets of individual conductors 21 and 23 are connected to a block of synthetic material 75, for example by means of an adhesive. The block 75 may also be an aluminium block provided with an oxide skin by anodizing. Prior to the anodizing process the block may be provided with positioning grooves in which the conductors 21, 22 and 23 can be positioned. The interconnected ends of the conductors of the set 22 are bent at right angles to the plane through the conductors and adhere to the side faces 76 and 77 of the block 75 or positioned in grooves. This measure prevents the occurrence of undesired edge effects in the magnetization pattern near the interconnected ends of the conductors.

Figure 5:
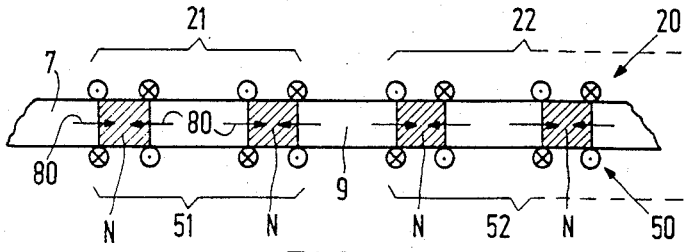

FIG. 5 illustrates an embodiment of the invention in which the magnetization of a mask section is carried out by means of mutually parallel oriented sets of conductors positioned on either side of the section. FIG. 5 is a sectional view through a horizontal row of apertures 9 of the arrangement shown in FIG. 4*a*. The positioning of the sets of conductors 21, 22 and 23 is that as shown in FIG. 4*a*. The sets of conductors of the coil 50, as those indicated by 51 and 52, are rotated through 90° in their plane and all currents therein have reversed their directions. Said current directions are indicated in FIG. 5 by means of a dot (direction towards the reader) and a cross (direction away from the reader). The induction fields generated in this case by the currents are indicated by arrows 80. After switching off the currents a magnetization corresponding to the pattern shown in FIG. 4*a* of north-poles N and south-poles S is obtained. In the configurations given in FIG. 4*a* the conductors of the sets 21, 22 and 23 generate north-poles N in the places indicated by N, while the conductors of the coil 50 generate south-poles in the places denoted by S. In the FIG. 5 configuration all conductors generate north-poles in the places denoted by N in FIG. 4*a* and south-poles are formed automatically in the places denoted by S in FIG. 4*a*. From the method described with reference to FIG. 5 it will be obvious that one coil 20 or 50 will also suffice for the magnetization. The resulting quadrupole strength with the same choice of current strength then is approximately half that obtained with an arrangement of two coils.

The invention has been explained with reference to a mask 7 in which the apertures 9 are arranged according to mutually perpendicularly oriented rows and columns. However, for using the invention this is not necessary and the apertures may also be arranged according to "rows" and "columns" not oriented mutually at right angles. In this case the conductors of one coil do not cross those of the other coil at right angles but at the same angle as that enclosed by the "rows" and "columns".

What is claimed is:

1. A method of manufacturing a colour cathode-ray tube comprising a magnetic quadrupole post-focusing mask formed by a plate of a magnetizable material in which apertures are provided so as to be arranged according to rows, sections of said plate being successively magnetized by positioning parallel conductors per section on at least one side of the plate in such manner that each time two conductors through which an electric current flows in opposite directions are present between two successive rows of apertures, a magnetic quadrupole being formed along the circumference of each of the apertures, characterized in that a first section is magnetized and then at least one subsequent section is magnetized, said subsequent section comprising an edge area extending parallel to the parallel conductors and coinciding with a part of a preceding section already magnetized according to the desired strength, and a magnetic induction is generated in the edge area according to a pattern corresponding to the already existing pattern of magnetization in said preceding section, the strength of said magnetic induction decreasing towards the outermost of the parallel conductors.

2. A method as claimed in claim 1, characterized in that upon magnetizing the said subsequent section a central area and two edge areas of the mask section extending on either side of the central area and parallel to the parallel conductors are magnetized, the strength of the magnetic induction in each of the edge areas decreasing towards the outermost of the parallel conductors.

3. A method as claimed in claim 1 or 2, characterized in that an edge area is determined by at least three outermost parallel conductors.

4. A method as claimed in claim 1 or 2 characterized in that the decreasing strength of the magnetic induction in an edge area is obtained by causing the current strength in the conductors which determine the edge area to decrease per conductor towards the outermost conductors.

5. A method as claimed in claim 4 characterized in that the magnetisation of a section is carried out by positioning first parallel conductors on one side of the plate and second parallel conductors on the other side of the plate, said first and second parallel conductors crossing each other.

6. A method as claimed in claim 4, characterized in that the magnetisation of a section is carried out by positioning first parallel conductors on one side of the plate and second parallel conductors on the other side of the plate, said first and second parallel conductors extending mutually in parallel.

7. A method as claimed in claim 1 or 2, characterized in that the magnetisation of a section is carried out by positioning first parallel conductors on one side of the plate and second parallel conductors on the other side of the plate, said first and second parallel conductors crossing each other.

8. A method as claimed in claim 1 or 2, characterized in that the magnetisation of a section is carried out by positioning first parallel conductors on one side of the plate and second parallel conductors on the other side of the plate, said first and second parallel conductors extending mutually in parallel.

9. A device for producing a magnetic quadrupole post-focusing mask from a plate of a magnetizable material in which apertures are provided in rows, comprising:

an insulating support;

at least a first and second set of mutually parallel conductors, said sets being juxtaposed on said insulating support in parallel non-overlapping relationship, conductors of said first set being interconnected in a zig-zag manner, the conductors of said second set being individual conductors each having its own electrical terminals.

10. A device as claimed in claim 9, wherein two said second sets of said conductors having their own electrical terminals are disposed on said support, a respective second set being on each side of said set of conductors interconnected in a zig-zag manner, said second sets of individual conductors each including at least three conductors.

11. A device as claimed in claims 9 or 10, wherein said insulating support is aluminum, said aluminum support being anodized at least at the surface thereof.

12. A device as claimed in claim 11 wherein said support includes positioning grooves wherein said conductors are situated.

13. A device as claimed in claim 9 or 10 wherein said support includes positioning grooves wherein said conductors are situated.

* * * * *